United States Patent [19]

Lehmann

[11] 4,382,304

[45] May 10, 1983

[54] DEVICE FOR AUTOMATICALLY MAINTAINING TOILETS CLEAN

[76] Inventor: Herbert G. Lehmann, 5 Kent Rd., Easton, Conn. 06612

[21] Appl. No.: 334,914

[22] Filed: Dec. 28, 1981

[51] Int. Cl.[3] ..... E03D 9/02; A61L 2/16

[52] U.S. Cl. ..... 4/228; 422/261; 422/266

[58] Field of Search ..... 4/222, 227, 228, 309; 422/240, 261, 266

[56] References Cited

U.S. PATENT DOCUMENTS

| | | | |
|---|---|---|---|
| 3,837,017 | 9/1974 | McDuffee | 4/228 |
| 3,869,069 | 3/1975 | Levey et al. | 4/228 X |
| 4,308,625 | 1/1982 | Kitko | 4/228 |

*Primary Examiner*—Charles E. Phillips

*Attorney, Agent, or Firm*—H. Gibner Lehmann; K. Gibner Lehmann

[57] ABSTRACT

A new article of manufacture, comprising a capsule intended to be dropped into the water tank of a toilet, to dispense metered amounts of a chemically active cleaning agent into the water over a long interval of time. At the end of such interval, the entire capsule has been substantially completely disintegrated and flushed away whereby its removal is not required, notably when a new capsule is to be dropped into the tank. The capsule comprises a container made of material which could be metal containing aluminum, that very slowly disintegrates under the action of the chemical cleaning agent contained therein at such time that the chemical becomes mixed with water. The capsule has one or more stoppers for water access openings, or has other means to enable water to enter it for acting on the cleaning agent. If stoppers are provided, these are removed prior to dropping the capsule into the tank. The chemically active cleaning agent can comprise the hypochlorite of an alkaline metal such as sodium or calcium.

29 Claims, 16 Drawing Figures

DEVICE FOR AUTOMATICALLY MAINTAINING TOILETS CLEAN

CROSS REFERENCES TO RELATED APPLICATIONS

Co-pending application of Herbert G. Lehmann, Ser. No. 317,581 filed Nov. 2, 1981 and entitled Method of Maintaining Toilet Bowls Clean and Product For Accomplishing Same.

BACKGROUND

This invention relates to automatic devices intended to maintain toilet bowls in a clean and sanitary condition without requiring any manual or mechanical action such as scrubbing with a brush.

In my co-pending application above identified there is disclosed a toilet bowl spray cleaner which does not require brushing, comprising a plastic squeeze bottle containing a strong bleaching solution and having a pivoted spout in the closure, to enable the solution to be easily and quickly sprayed on the exposed bowl surfaces, after which flushing is not done for a number of hours to enable the bleaching solution to act on the surfaces and dissolve any contaminating deposits. With this spray cleaner, good results are obtained if the spray application is made each night before retiring, so that the next flushing of the toilet occurs the following morning. This gives the chemical bleach solution a goodly amount of time to react on the bowl surfaces. However, such cleaning procedure requires the housewife or other person to apply the spray solution to the bowl daily or almost so, in order that the cleaning action is effective.

So-called "automatic" bowl cleaners are presently marketed, comprising containers or jars having granules of a bleaching chemical such as sodium or calcium hypochlorite. These jars are intended to be opened and then placed in the bottom of the tank of the toilet, underneath the float. The action of the water on the chemical granules causes a dispersion of the hypochlorite in the tank water, and each time that the toilet is flushed, the charged water in the tank passes over the exposed bowl surfaces and re-acts on the same, presumably to keep such surfaces clean. The bleaching solution in the tank is designated as being safe for plumbing. Such devices can last as long as three or four months, corresponding roughly to 2,000 or more flushes. When the chemical is all used up, the jar must be removed from the bottom of the tank before it can be replaced by a new, freshly-opened jar.

While these automatic jar devices did not require the daily attention of the maintenance person, they were inconvenient to install since the user had to remove the tank cover completely and get one hand and arm wet when placing the jar in the water under the float. Also, the previous empty jar, if there was one, required removal each time prior to being replaced with a new jar. The user was thus under any circumstance always required to reach into the tank water, and this constituted an undesirable aspect of these devices.

So far as I am aware, efforts to provide other types of automatic water-treatment devices acting like the above jars but where the containers did not require removal, such as wherein the active chemical could be in the form of a solid cake which would ultimately dissolve without residue, have not been successful.

In the case of a solid cake of chemicals, it is not possible, according to my knowledge, to retard the dissolving to an extent sufficient to provide a useful life of at least a month or more. I believe that the porosity of any solid cake will defeat a sufficiently slow, dissolving action since the water in which the cake is immersed permeates quite readily throughout the entire body of the cake; thus the solid structural formation of the cake weakens whereby the usual swirling action of the water in the tank quickly disperses the active chemicals, which are then undesirably prematurely flushed down the drain. As at present understood, no sufficiently-slow dissolving action is possible, in a solid cake containing an active, water soluble chemical. The hypochlorite by its very nature tends to readily dissolve in moving water, thereby defeating the desired objective of a very slowly dissolving cake of chemical substance.

In consequence, all prior automatic toilet bowl cleaners of the type intended to be used in the tank, to my knowledge employed some type of non-soluble or non-disintegrating container such as of plastic or glass which was immersed in the water, and which had to be removed after the contained chemical ceased to function. This applying and removing operation constituted a messy and troublesome chore. Usually water would drip from the container being removed, requiring a cleaning-up operation of the floor around the toilet bowl. The prior devices always required that the user get his or her hands wet, in initially installing or else in replacing the devices.

SUMMARY

The above disadvantages and drawbacks of prior automatic toilet-bowl cleaning devices are obviated by the present invention, which has for one object the provision of a novel and improved automatic chemical toilet cleaner in the form of a capsule or container which can be merely dropped into the tank in the vicinity of the float without requiring the user to carefully place the device in the water and locate it according to the given directions, getting the hand and arm wet in the process.

Another object of the invention is to provide an improved chemical cleaning device for toilets as above set forth, which will automatically eventually dissolve in the tank water and disappear whereby no removal of an empty container is required when replacement with a new chemical cleaner is to be done.

A further object of the invention is to provide an improved chemical cleaning device for immersion in the tank of a toilet fixture as above characterized, which is especially simple in its construction and economical to fabricate.

A feature of the invention resides in the provision of an improved automatic chemical cleaner for disposition in the tank of a toilet fixture in accordance with the foregoing, which can be easily and quickly made ready by the user, prior to its being dropped into the tank.

Still another object of the invention is to provide an improved self-dissolving chemical cleaner as above characterized, which is especially safe in its use and not likely to cause injury to personnel.

Other features and advantages will hereinafter appear.

In accordance with the above objectives, the invention provides a unique capsule or container construction which is intended to be dropped into the water tank of a toilet fixture so as to dispense metered amounts of a chemically-active cleaning agent into the water over a relatively long interval of time. At the end of such interval, the capsule has substantially completely disintegrated whereby its removal is not required when a new capsule is to be dropped into the tank. The capsule construction can comprise a special metal container having thin walls, which is made of a metal containing aluminum that very slowly disintegrates under the action of the chemical cleaning agent contained in the capsule, this occurring in the presence of water and commencing at the time that the chemical initially mixes with the water. For the installation of the capsule, the user first removes a stopper so as to open the capsule prior to dropping it into the tank. Optionally the user also can snip off a corner portion of the capsule, when the latter is in the form of a collapsible tube. These preliminaries are readily done prior to dropping the capsule into the tank. The chemically active cleaning agent can comprise the hypochlorite of an alkaline metal, such as sodium or calcium.

Or, the capsule can comprise another material which is so constituted as to very slowly dissolve and disintegrate under the action of water. One such material, for example, could be a wood product treated to rot away when in water; or molded, cemented fibers adhered together by and adhesive or cement which dissolves very slowly after air hardening or curing.

In the accompanying drawings, showing several embodiments:

Figure 2:
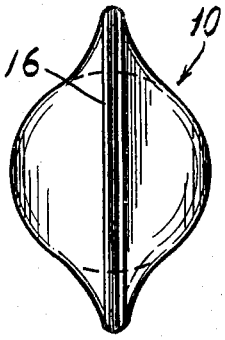
FIG. 2 is a left end elevational view of the capsule of FIG. 1.
Figure 1:
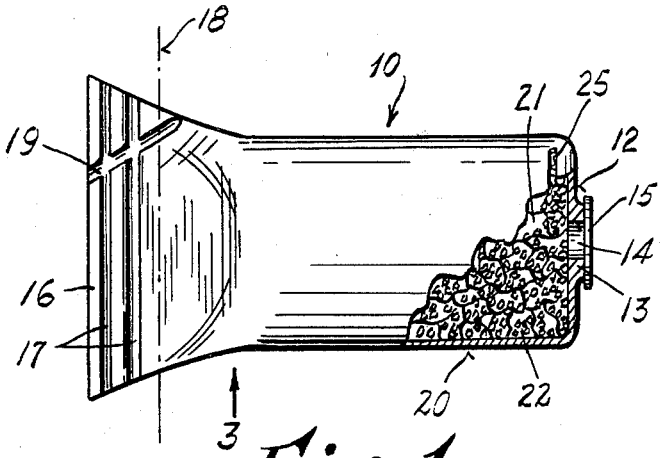
FIG. 1 is a side elevational view, with portions broken away, of the improved cleaning capsule of the invention.
Figure 3:
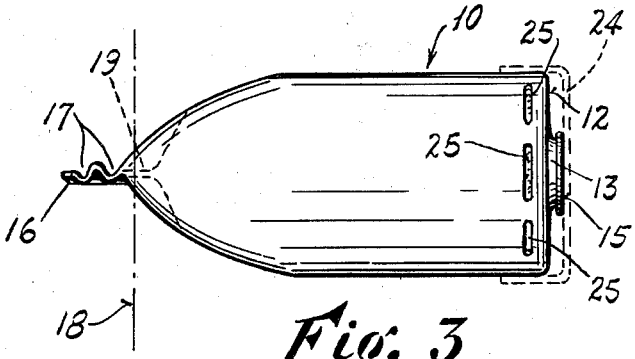
FIG. 3 is a different side elevational view of the capsule, looking in the direction of the arrow 3 of FIG. 1.

Referring first to FIGS. 1–3, the improved, slowly-dissolvable or decomposable chemical cleaning device of the invention comprises a container 10 which in one form can be an elongate collapsible tube constituted of a metal which contains aluminum, or of any other metal or metallic alloy which is readily attacked and disintegrated under the action of a corrosive liquid such as sodium or calcium hypochlorite, or solution of a salt of an alkaline metal disposed in the container. The container 10 can be advantageously fabricated as a deep-drawn stamping having at one end a transverse wall 12 formed with a ring-shaped thickened wall section 13 and a stoppered opening 14 which latter is sealed by a removable paper stopper or closure 15.

At its other end the tube 10 is flattened, providing a thin, double-thickness edge 16 and transverse embossed rib portions 17 which latter have the effect of maintaining the two wall portions in close engagement and essentially interlocking to effect a seal.

From the foregoing brief description it can now be understood that the concept of the invention involves a corrosive solid substance preferably in the form of soluble granules which are contained in a water-pervious container either constituted of a metal or else of a non-metallic substance which will slowly decompose under the action of water with or without the corrosive chemical in solution, requiring for such dissolution an appreciable period of time such as a number of weeks or months.

Considering again the figures, the end wall 12 of the container 10 is made as thick as the cylindrical side walls 20, and the flattened wall portions 16 which are disposed to the left of the reference line 18 have a thickness which is quite small, chosen to be a lesser thickness than the cylindrical wall portion 20. The line 18 could be considered as indicating a demarkation line between the two differing wall thicknesses.

A transverse marker rib 19 is provided at one corner of the flattened end of the tube 10, and such rib can indicate where the user is to snip off the corner portion so as to provide an opening for the passage of liquid into and out of the container. Removal of the stopper disc 15 also provides for the passage of water into and out of the container, and by the provision of such passages at both ends of the container there is minimized the likelihood of an air lock in the container.

Disposed in the container 10 are granules 21 which can be advantageously constituted of a corrosive and bleach substance such as calcium hypochlorite. Also, smaller granules 22 of a colored inert plastic composition can be included in the container 10, to impart color to the chemical solution which emanates from the container.

Figure 6:
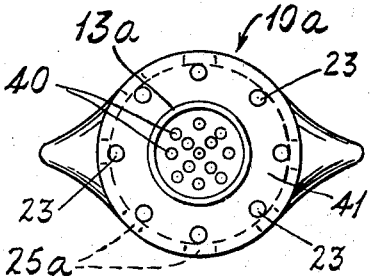
FIG. 6 is an end elevational view of yet another capsule constituting a third embodiment of the invention; a removable snap closure provided for the capsule is not illustrated in this figure.

The end wall 12, with the exception of the central opening 14, can be solid as shown in FIG. 1, or it can have perforations such as those indicated at 23 in FIG. 6 which relates to another embodiment of the invention.

A resilient snap closure 24 of shallow, cup-like configuration can be applied to the circular end of the container 10, as seen in FIG. 3, and when snap closure is used the thin closure disc 15 can be dispensed with.

The cylindrical walls of the container 10 adjacent the end wall 12 can be provided with a plurality of openings or slots 25 which will also be sealed closed by the snap closure 24. The additional openings 25 give added insurance against the likelihood of an air lock existing in the container 10.

In accordance with the invention, the chemical cleaning device illustrated in FIGS. 1–3 is intended to be first opened by the user, as by snipping off the corner of the container along the rib 19, and then removing the closure 15 and/or the snap closure 24. When the corner is snipped along the rib 19 the two cut wall edges will remain fairly closely spaced, thereby to restrict the size of the opening and retain the granular contents in the container against premature dissolution. The user, after opening the container, then merely drops it in the water tank in the vicinity of the float. The container will immediately sink to the bottom, and water will enter through the various openings provided, including the snipped-off corner portion at the rib 19.

It is at present preferred to make the cylindrical side wall 20 of the capsule of tapered thickness, with the thickest portion being adjacent the transverse wall 12 and preferably of only slightly less thickness than the transverse wall.

I have found that with a chemical cleaning device as above set forth, an erosion of the aluminum of the container 10 will start to occur as soon as the container is dropped into the water tank, while at the same time the hypochlorite chemical in the container will mix with the water entering the latter and gradually meter out to mix with all of the water in the tank, this occurring especially in consequence of the turbulence which happens each time the tank is emptied into the toilet bowl. Thus, the water in the tank itself is maintained in a clean and sanitary condition due to the bleaching and corrosive action of the hypochlorite, and this same is true of the water in the toilet bowl. The flushing action also causes the tank water to flow over the exposed surfaces of the bowl, washing away any discoloration and deposits which may remain. Thus, the chemical capsule device of the invention results in a cleaning action on the toilet bowl, as well as within the water tank.

Depending on the sizes of the openings in the container 10, the hypochlorite therein can be made to only gradually dissolve, and to be only gradually dispersed throughout the tank water. Also involved in such action is the number and frequency of flushes of the tank water. The chemical in the container can therefore be made to last for a number of weeks or months before it is completely used up. Just prior to the termination of such period, the corrosive action of the chemical will have finally essentially completely dissolved the very thin walls of the flattened end portion 16 of the capsule, and the very slightly thicker cylindrical walls 20 thereof. The transverse wall 12 will also have fully eroded, leaving only the thickened ring portion 13. This portion 13 will remain on the bottom of the tank and gradually be decomposed over an additional period of time, as can now be understood. In any case, its presence will not interfere with the action of the tank, or of the plumbing in the tank.

The breaking away of the aluminum metal walls of the container can occur in only small fragments at a time, and these in many cases can be imperceptible or else so small as to not cause problems with the valve or stopper mechanism of the tank. Ultimately the final aluminum residue will be decomposed by the natural corrosive action of the tank water, which usually contains acid fall-out from the atmosphere and/or chlorine and fluorides added for special purposes by the water company.

Figure 5:
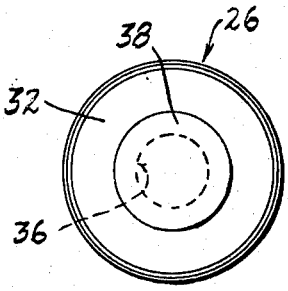
FIG. 5 is a left end elevational view of the capsule of FIG. 4.
Figure 4:
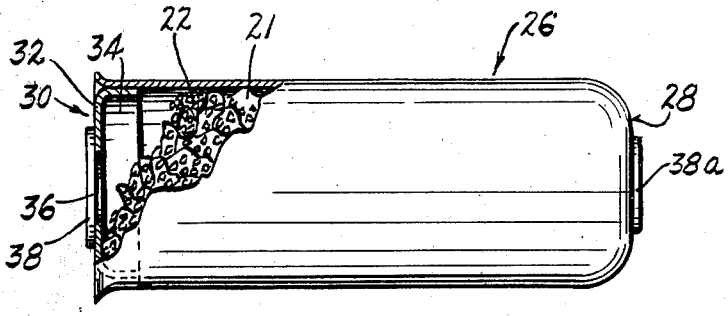
FIG. 4 is a side elevational view of a different type of capsule, constituting another embodiment of the invention.

Another embodiment of the invention is illustrated in FIGS. 4 and 5 wherein a tubular container 26 has a transverse end wall 28 which can be imperforate, or else perforated as with openings like those indicated in FIG. 6 at 23. A snap closure 24 (shown dotted in FIG. 3) can be applied over the end wall 28 of the container 26.

At its other end the container 26 receives a removable end plug 30 which is frictionally retained and which has an apertured transverse wall 32 and a mounting flange 34, the aperture 36 of the wall 32 being stoppered as by a removable disc 38 normally held with adhesive. An adhesively-held stopper disc **38*a* can be on the wall 28 also, if such wall is perforated. Granules 21 and 22 are shown as contained in the cartridge 26**.

Just before use of the device of the invention, the stopper disc 38 is peeled off, and the stopper disc **38*a* or the cap 24 removed, if either one of these latter is also provided on the wall 28. The container is then dropped into the water tank in the vicinity of the float, as explained above in connection with FIGS. 1–3**.

When the container 26 and walls 28 and 32 are mostly eaten away, there will remain a ring-shaped form constituted of the flange 34 and the wall in which it was pressed, since these represent thicker sections. This ring formation will remain on the tank bottom and gradually disintegrate, as will be understood.

Figure 7:
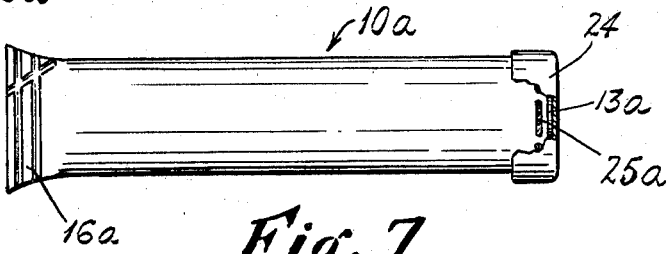
FIG. 7 is a side elevational view of the capsule of FIG. 6, with portions of a removable snap closure broken away.

Still another embodiment of the invention is illustrated in FIGS. 6 and 7 wherein a cartridge-type or tubular container **10*a* has a flattened end portion 16*a* and a transverse end wall 41, the latter being provided with a plurality of apertures 40 disposed within a ring-shaped thickened wall portion or bead 13*a***.

The snap cap 24 can be applied over the circular end of the container **10*a*, and the latter can have a plurality of openings 25*a* in its cylindrical wall, these being also stoppered by the snap cap 24**.

The distance between two adjoining ends of the slots 25 is substantial, as is the distance between adjacent openings 23. In each case it is much greater than the thickness of the walls 20 or 41. Therefore the corrosive action on the walls will be mainly one of attacking the expensive inner and outer surfaces, as opposed to corrosion of the edge surfaces at the slots 25 or openings 23.

Figure 8:
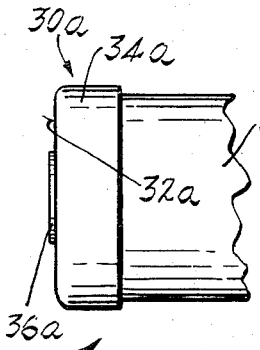
FIG. 8 is a fragmentary side view partly in elevation and partly in section, of a modification of the embodiment of FIG. 4.

A modification of the embodiment of FIGS. 4 and 5 is illustrated in FIG. 8. According to this modification, the cartridge **26*a* is provided with an end cap 30*a* in the form of a shallow cup, having an annular mounting flange 34*a* which extends around and frictionally fits the end of the cartridge 26*a*. The cap 30*a* has a bottom or end wall 32*a* provided with a multiplicity of small perforations such as those designated at 23 in FIG. 5, which are closed over by a removable, adhesively-held paper disc 36*a*. The flange 34*a* can have a very slight taper whereby, as it is applied to the cartridge body 26*a*** it fits more tightly so as to be frictionally held thereby.

With such modification of the embodiment of FIGS. 4 and 5, as shown in FIG. 8, the thicknesses of the end walls 28 and **32*a* and of the cylindrical wall of the cartridge body 26*a* can all be equal whereby such walls will be eaten away or corroded at substantially the same rate, so that at the end of the useful period for the chemical granules, all such walls will essentially become extremely thin sections and finally disappear. However, the mounting flange 43*a* and the end wall portion of the cartridge 26*a* surrounded thereby will usually remain, since they in effect constitute a thickened ring formation of approximately twice the thickness of the other wall sections. Such remaining ring formation will lie on the bottom of the tank and gradually erode under the action of the natural corrosive elements of the tank water, such as that resulting from acid fallout from the atmosphere, and from the addition of chlorine and/or fluorides as may be provided by the water company for various purposes. The cartridge body 26***a* could be constituted of specially treated wood or other non-metallic fibers which will quite quickly rot away or decompose when in water, or in the presence of a solution of the granules that are contained. Or, the fibers could be molded to the desired container shape, with a cement or adhesive that will very slowly decompose when in water, or in the presence of a solution of the granules.

It will be noted that the cleaning cartridge of this invention has the distinct advantage of not requiring the user to dip his or her arm into the water of the tank at any time, as for example when placing the cartridge therein; also it has the advantage that the cartridge eventually will essentially completely dissolve whereby it does not require removal at the end of its period of usefulness. In this connection it is pointed out that the wall thicknesses are so related to each other as to become paper thin while still remaining substantially intact, before any large disruption occurs which could expose an appreciable quantity of the granules to all of the water in the tank. Wall thickness differences in thousandths of an inch are to be observed.

Still other embodiments of the invention are illustrated in FIGS. 9–13, wherein cartridge bodies are constituted of non-metallic materials such as wood, wood fibers, cotton fibers, plastic fibers, treated paper and cardboard, glass fibers and synthetics.

Figure 9:
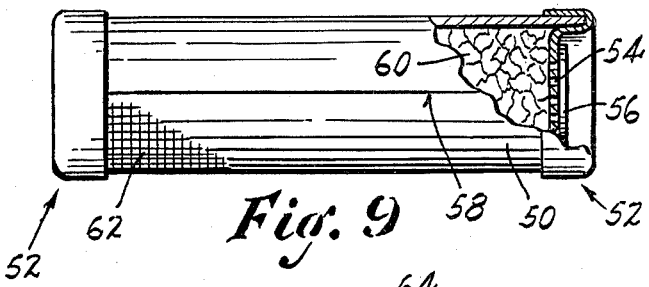
FIG. 9 is a side elevation of another embodiment, utilizing a wooden capsule body and metal end caps.

Referring to FIG. 9 there is shown a cartridge body of tubular configuration, designated 50, which can be formed to initially have open ends. The open ends are closed by metal end caps 52 which can be of aluminum and have perforations 54 that are closed by peel-off discs 56. Peripheral portions of the caps 52 are formed with annular grooves as shown, to closely fit the end portions of the body 50, which can be made of wood veneer shaped into a cylinder with a butted-edge joint 58 that is cemented or glued to form a tight seam. In the body 50 are carried the granules of calcium hypochlorite 60. The body 50 can, as well, be constituted of cardboard that is suitably treated to withstand the action of the hypochlorite for a desired period of time. Treatment with a plastic composition can be used, to delay the action of the corrosive chemical in the body, keeping in mind the desired relationship to the rate of disintegration of the aluminum end caps 52. The non-metallic body 50 can be encased in a cylindrical jacket 62 formed of aluminum screening, to effect a special control over the disintegration and disffusion of the body 50 into the tank water.

Figure 10:
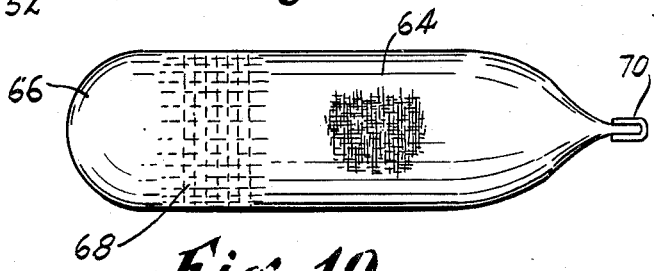
FIG. 10 is a side elevation of still another embodiment, comprising a woven cloth capsule with metal end clamp as a closure.

In FIG. 10 there is shown a woven tubular body 64 having a woven closed end 66. Treated or untreated cotton strands may be used, in forming the body. Or strands of suitable plastic substance, giving a cloth-like texture. A tight, heavy weave will provide a greater delay interval before the body 64 disintegrates. A mixture of different strands can be used in a pattern, whereby the more resistant strands form a net-like configuration that remains for a brief period after the remainder of the body has disintegrated. This configuration is indicated by the numeral 68. As viewed in the figure, the right end of the body 64 is closed after filling with the chemical granules, by an aluminum clamp 70. Water will enter the body through the interstices of the weave, to act on the chemical, and the solution will pass out through said interstices upon flushing of the toilet, due to the turbulence of the tank water. All of the materials of the device of FIG. 10 will ultimately disintegrate and flush out with the tank water, since they will piecemeal break away, slowly at first while still retaining the given shape necessary to contain the granules.

Figure 11:
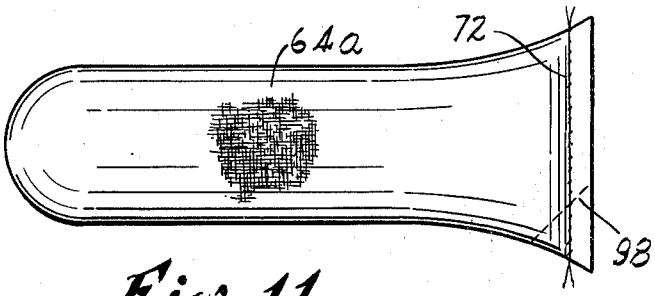
FIG. 11 is a side elevation of a cloth capsule with stitches.
Figure 12:
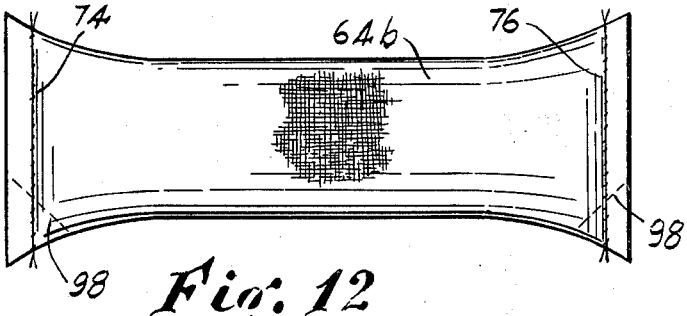
FIG. 12 is a side elevation of a cloth capsule with stitches at both ends to effect the closure means.

A modification of the FIG. 10 construction is shown in FIG. 11, wherein the capsule body 64*a* has its right end closed, after filling, by a line of stitches 72. Another modification of the FIG. 10 construction is illustrated in FIG. 12, wherein the cloth body 64*b* has both ends closed by lines of stitches 74, 76.

Figure 13:
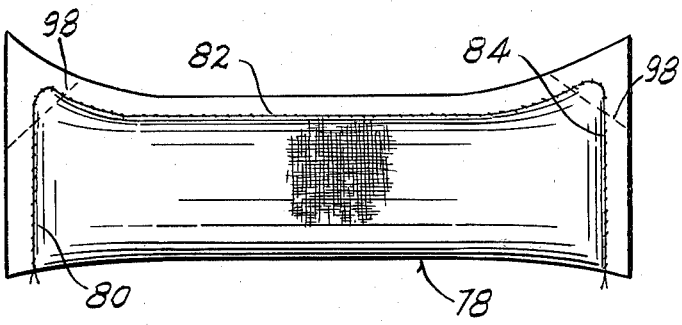
FIG. 13 is a side elevation of a cloth capsule with three rows of stitches utilized in its fabrication.

FIG. 13 shows a capsule body formed by taking a flat piece of cloth and folding it in half along a fold line 78. Lines of stitching 80, 82 and 84 complete the operation, to form a closed container for the chemical granules.

Figure 14:
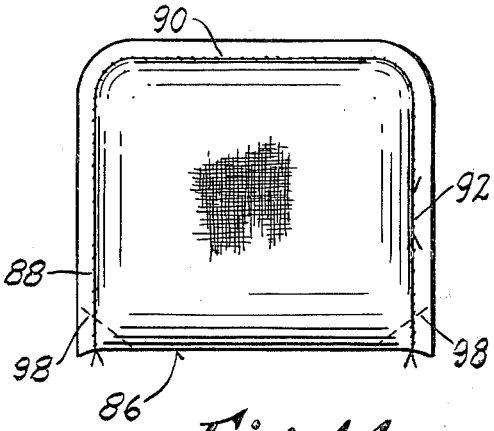
FIG. 14 is a side elevation of a cloth container having stitches and a rectangular configuration.

FIG. 14 is a modification of the construction of FIG. 13, wherein a cloth folded in half along a crease line 86 has a rectangular shape, and is made into a container by lines of stitches 88, 90 and 92.

Figure 15:
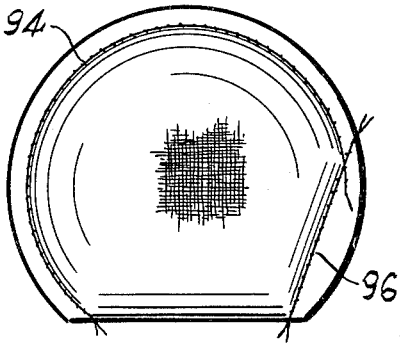
FIG. 15 is a side elevation of a cloth container that is of semi-circular shape, utilizing stitches to effect the closure.

FIG. 15 is along the lines of FIG. 14 except that the shape is semi-circular, and there are two lines of stitches 94, 96. The woven or cloth containers of FIGS. 10–15 can have a loose weave, and the contained granules can be of relatively large size whereby they will not pass through the interstices of the cloth. In such case, no additional openings need be required in the containers. However, if in some special circumstance larger openings are desired, these can be readily provided in the following manner: In FIG. 10, an end portion of the clamp 70 and a corner portion of the container 64 can be readily snipped off with a scissors. In the embodiments of FIGS. 11–14, corner portions of the cloth bags can be snipped off along the marker lines designated 98. Either one or else two corners of the cloth bags can be snipped off; in the case of FIGS. 12 and 13, four such corners can be snipped off, if desired.

The configuration of the bag of FIG. 15 does not readily lend itself to snipping off a corner. For such shape, dependance can be had on the loose weave of the cloth.

The woven containers of FIGS. 10–15 can be constituted of several different types of fibers, in a mix. For example, a very fine polyester thread can be used in conjunction with cotton threads to form a weave which will be largely consumed under the action of the hypochlorite solution. When the granules are almost fully consumed, the cotton fibers will likewise be fully consumed and there will remain only a very flimsy skeleton net, of very fine polyester fibers which can readily pass out through the tank outlet and be flushed down the drain of the bowl. Polyester fibers of very fine diameter, measured in thousandths of an inch, could be used depending on the results required. By suitable treatment of the fibers or threads making up the woven containers, together with a selection of the make-up of the fibers, various time intervals of delay can be had, for the cleaning capsule.

In the embodiment of FIG. 9 the container or cardboard body 50 can be treated with a retarding substance, such as a synthetic impregnant which will slow down the action of the hypochlorite on the wood grain or cardboard-paper composition, as can be understood.

Where the closing of the container is effected by stitching, the sewing threads may be so chosen as to resist the action of the hypochlorite at the same rate, or else at by a slightly greater amount than the body of the capsule.

Not all synthetics resist the action of the hypochlorite solution. Some, such as acetate and like fibers used in the making of satin, become dissolved quite rapidly, this same being true of woolen fibers as well as human hair. In sharp contrast, cotton fibers such as used in the making of white cord will withstand the action of the hypochlorite for quite a period.

As at present understood, a treatment of such cotton fibers which adapts them for twine or thick white cord or string, lengthens the period of resistance to decomposition. Those skilled in the chemical art can readily determine, experimentally and otherwise, the materials which become dissolved quickly, and those which require an appreciable length of time to be dissolved. The thickness or mass of the material is a determinant, since fine fibers can succumb much more quickly than thicker fibers of the same material. Chemical impregnants can be used, especially where the wall thickness is appreciable, as in the case of the embodiment of FIG. 9, to control the rate of decomposition. A wall of wood or wood composition can be created to provide the desired delay. If a composition wall is made up of discrete wood or other fibers, the binder can be so chosen as to provide the desired retarding effect.

Very fine fiberglass fibers will be found to be resistant to the action of the hypochlorite to a marked extent, and such fibers in the form of threads could be interwoven with less resistant fibers to form the cloth, as was mentioned above in connection with polyester fibers or threads. In any case, the more resistant material when used with other less resistant materials, preferably will constitute a very small proportion of the mix thereby, if strands of such material were to stand alone, they would form an extremely fine, fragile mesh which could be readily flushed away upon the termination of the usefull life of the device.

The construction of the various embodiments is seen to be especially simple, and the containers are easily handled and placed into use by the housewife. The devices are especially economical to fabricate and produce. So far as I am aware, I am the first to provide a time-elapse automatic toilet-cleaning device which can be merely dropped into the water tank of a toilet, and which will be essentially completely disintegrated and decomposed after serving usefully for a period of time to effect an automatic cleaning whereby it does not require a manual removal.

As a general rule, fibers or threads of esters, polyester, glass and the like will need no treatment in withstanding the action of the hypochlorite, whereas cotton fibers or threads could be provided with a coating or impregnant, such as a very light waxing (with beeswax or petroleum-based wax) or treatment with an inert synthetic, which could include lacquers, shellac, varnish etc. to extend the period of resistance to disentegration. Mercerized cotton thread can be used in the make-up of the containers, either with or without additional treatment, and also nylon.

Silk is quickly dissolved by the hypochlorite, and appears to have no usefulness. If wood is used in the make-up of the container, it will be found that the lignin and associated layers of the wood resist the hypochlorite to different degrees. Wood or cardboard walls can be provided with multiple perforations to accelerate the disintegrating action. Such walls are soon fully permeated by the bleach solution, which remains and acts to disintegrate the material.

Figure 16:
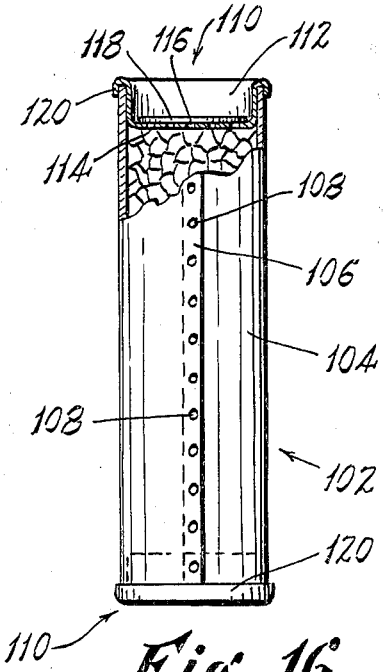
FIG. 16 is a view partly in axial section and partly in side elevation, of an all metal capsule made in accordance with the invention.

Yet another embodiment of the invention is illustrated in FIG. 16, which shows an all-metal capsule 102 comprising a tubular aluminum body 104 which is formed by rolling a sheet and securing the longitudinal edges together by an interlocking joint 106. The interlocking joint 106 can be formed in any suitable manner; one simple way is to merely fold back the two mating edges on themselves first, and then fit them together so that the folded edges interlock. The interlocking joint can be additionally formed to provide stamped-in indentations 108 which tend to prevent separation of the two walls making up the joint.

Stamped aluminum end caps 110 are provided, each with a flange 112 joined to a transverse wall 114 provided with perforations 116 and a closure tab 118. The end caps 110 have folded back portions or flanges 120 which can be laid over the ends of the container 104 so as to grip the latter.

The construction illustrated in FIG. 16 may be very economically carried out, and as with the other embodiments of the invention, the container will gradually deteriorate and disintegrate during the useful period of the hypochlorite.

Variations and modifications are possible without departing from the spirit of the claims.

I claim:

1. As a new article of manufacture, a device for maintaining toilets in a sanitary condition, said device being adapted to become completely disintegrated after immersion for an extended period of time in water, and said device comprising, in combination:

(a) a quantity of dry granules characterized by a corrosive and bleaching action when combined with water, and (b) a container for said granules, having means providing for the passage of fluid between its inside and its outside when the container is immersed in water, (c) said container being constituted of a material which slowly disintegrates when in an aqueous solution of said granules, (d) all the walls of said container being gradually eaten away when the container is placed in a body of water which wets said granules, and when the container is allowed to remain in said body of water over an extended period of time.

2. A device as defined in claim 1, wherein:

(a) the material of the container is a metal containing aluminum.

3. A device as defined in claim 1, wherein:

(a) the container has a thicker wall portion of ring-shaped configuration, which is the last to disintegrate.

4. A device as defined in claim 1, wherein:

(a) the container has a closure and an opening stoppered by the closure and constituting the means providing for fluid passage when the closure is removed, (b) the walls of said container being sufficiently thin to enable the container to be substantially completely disintegrated eventually, after the closure is removed.

5. A device as defined in claim 4, wherein:

(a) the container is elongate, (b) said closure and opening being disposed at one end of the container, (c) said container having means enabling a second opening to be provided at its other end, thereby to minimize the likelihood of air being trapped in the container when it is placed in said body of water.

6. A device as defined in claim 4, wherein:

(a) the container is elongate, (b) said closure and opening being disposed at one end of the container, and (c) said container having an additional opening at the said one end, and (d) said closure stoppering the said additional opening.

7. A device as defined in claim 4, wherein:

(a) the portion of the container which has the opening comprises a removable wall which is frictionally held on the container.

8. A device as defined in claim 1, wherein the granules are a hypochlorite of an alkaline metal.

9. A device as defined in claim 8, wherein the alkaline metal is calcium.

10. A device as defined in claim 1, wherein the period of time embraces a number of months.

11. A device as defined in claim 1, wherein:

(a) the container comprises a tube one end of which is flattened to close it.

12. A device as defined in claim 11, wherein:

(a) the flattened end of the tube has a transverse marking at its corner, to indicate a cut-off place for effecting an opening in the tube.

13. A device as defined in claim 12, wherein:

(a) the other end of the tube has a plurality of openings around its periphery, and (b) a resilient removable closure cap snapped over said other end of the tube, to close said plurality of openings.

14. A device as defined in claim 13, wherein:

(a) said other end of the tube has an axial opening that is stoppered by said resilient closure.

15. A device as defined in claim 1, wherein:

(a) the container has a thickened, ring-shaped wall section extending around said opening, which requires a longer period of time to disintegrate than the remaining wall sections of the container.

16. A device as defined in claim 15 wherein:

(a) the container has additional openings disposed within said ring-shaped wall section.

17. A device as defined in claim 15, wherein:

(a) the container has an additional opening disposed outside of said ring-shaped wall section, said additional opening being stoppered by said resilient closure.

18. A device as defined in claim 1, wherein:

(a) the container comprises a drawn metal tube having its mouth portion flattened to close the tube, (b) said flattened mouth portion having thinner walls than the remainder of the tube.

19. A device as defined in claim 18, wherein:

(a) the tube has an integral transverse wall at the end opposite to the flattened mouth portion, (b) the side walls of the tube being as thick as said transverse wall.

20. A device as defined in claim 19, wherein:

(a) the side walls of the tube have a substantially uniform thickness.

21. A device as defined in claim 1, wherein:

(a) the alkaline metal is sodium.

22. A device as defined in claim 1, wherein:

(a) the container includes a smaller, weighted mass which remains at the bottom of the tank after most of the container has disintegrated.

23. A device as defined on claim 1, wherein:

(a) the container is constituted of woven cloth.

24. A device as defined in claim 23, wherein:

(a) said cloth has some of its strands disposed in a predetermined pattern, (b) said strands of predetermined pattern being more resistant to the action of a solution of said granules than other strands of the cloth.

25. A device as defined in claim 24, wherein:

(a) the other strands of the cloth comprise cotton.

26. A device as defined in claim 23, wherein:

(a) the cloth comprises strands of cotton.

27. A device as defined in claim 26, wherein:

(a) the cotton strands have a retardant substance which retards the action of a solution of said granules on them.

28. A device as defined in claim 23, wherein:

(a) the container cloth has a line of stitches and is shaped to store a quantity of said granules, (b) said stitches constituting a closure means for the container.

29. The method of maintaining in clean and sanitary condition a toilet water tank and bowl, which includes the steps of dissolving, in running water within the tank and at a controlled rate, granules of a corrosive salt of an alkaline metal, said granules being contained in a pervious container immersed in the tank and constituted of a material which is slowly disintegrated when in an aqueous solution of said granules, and simultaneously disintegrating said container at a controlled rate by the solution resulting from the controlled dissolution of said granules, with massive corrosion of the container to effect a major opening thereof occurring only after a major portion of said granules has become completely dissolved and carried off from the tank to the bowl.

* * * * *